United States Patent [19]

Frodrich et al.

[11] 4,078,570

[45] Mar. 14, 1978

[54] MOUNTING ASSEMBLY FOR SOOTHING TEATS

[75] Inventors: Horst Frodrich; Lutz Kesselring, both of Zeven, Germany

[73] Assignee: Mapa GmbH Gummi-und Plastikwerke, Hanover, Germany

[21] Appl. No.: 713,040

[22] Filed: Aug. 10, 1976

[30] Foreign Application Priority Data

Jun. 18, 1975 Germany ..... 2527040

[51] Int. Cl.[2] ..... A61J 17/00

[52] U.S. Cl. ..... 128/359

[58] Field of Search ..... 128/359, 360; D83/1 R, D83/8 C

[56] References Cited

U.S. PATENT DOCUMENTS

| | | | |
|---|---|---|---|
| 2,717,603 | 9/1955 | Colm | 128/360 |
| 3,964,489 | 6/1976 | Kesselring | 128/360 |

FOREIGN PATENT DOCUMENTS

| | | | |
|---|---|---|---|
| 779,618 | 1/1935 | France | 128/360 |
| 1,278,073 | 9/1968 | Germany | 128/360 |
| 2,420,829 | 4/1974 | Germany | 128/360 |

*Primary Examiner*—Robert W. Michell
*Assistant Examiner*—Michael H. Thaler
*Attorney, Agent, or Firm*—Toren, McGeady and Stanger

[57] ABSTRACT

A mounting assembly for infants' soothing teats comprising a teat nipple with an integral shaft portion made of an elastic material, a clamp member inserted into the shaft portion of the teat nipple, and a shield type mouth plate mounted on the shaft portion of the teat nipple wherein the clamp member includes an abutment surface and one or a plurality of integral yieldably movable locking elements adapted to cooperate with the abutment surface to safely retain the soothing teat assembly in its assembled relationship. The locking elements may consist either of articulated lugs being biased into a predetermined locking position by their inherent resiliency, or of slidably movable wedge members adapted to be selectively adjusted into a retaining position.

13 Claims, 10 Drawing Figures

MOUNTING ASSEMBLY FOR SOOTHING TEATS

The present invention relates to a mounting assembly for infants' soothing teats, i.e. so-called comforters or dummies. Heretofore known mounting assemblies for infants' soothing teats generally comprise a teat nipple made of an elastic material such as rubber. The teat nipple includes a shaft portion. A clamp member is provided and includes a mounting portion of an outer configuration mating the inner configuration of the teat nipple shaft portion. The teat nipple shaft portion is mounted on the mounting portion of the clamp member, and the mounting portion may have at least one external profile section. A mouth plate or shield with an aperture surrounds the teat nipple shaft portion. The teat nipple shaft portion is mounted on the clamp member mounting portion and extends together with the clamp member mounting portion through the aperture in the mouth plate. At the end of the clamp member inserted into the teat nipple shaft portion may be provided laterally extending elements.

When assembling mounting assemblies of the above described type, initially the teat nipple shaft portion the end of which is generally provided with a bead will be inserted through the aperture of the mouth plate, and subsequently the clamp member is introduced into the teat nipple shaft portion by urging the external profile section provided at the inserted mounting end through the aperture of the mouth plate. This operation relies particularly on the elasticity of the teat nipple material. During this assembling operation, considerable stresses will be generated within the elastic material. The external, i.e. outwardly projecting profile sections should be of slightly undersize dimensions with respect to the aperture in the mouth plate.

The soothing teat device which may likewise be described as a comforter or dummy may be of a configuration adapted to the anatomy of the infant's jaw-bones, or of any other suitable configuration. The clamp member may be of a circular cross-section, i.e. include a cylindrical shaft portion in which the external profile section consists of an annular peripheral bead, or may be flat with bead type or substantially wedge tip type external profile sections at both sides of the clamp member. It is likewise known to provide a split clamp member shaft portion comprising two halves that are interconnected in the vicinity of a holding means such as a holding ring attached to the clamp member end projecting from the teat nipple shaft portion.

When the clamp member is of a flat configuration there may likewise be provided projecting profile sections along the narrow sides of the clamp member end.

The present invention is likewise applicable to clamp members that are split at least in the region of the mounting end and are of a circular or a flat configuration. The two legs of the clamp member are interconnected in the region of the holding means of the teat nipple and include at their outer ends external profile sections that may particularly be of a wedge type configuration.

The above described undersize dimensions of the external profile sections require considerable assembling forces and involve the risk that the clamp member including e.g. a ring as a holding means at its outer end may be withdrawn from the teat nipple so that the teat nipple is liable to disintegration. The risk is especially pronounced in assemblies including a split clamp member shaft portion in which the two halves may slidably move relatively to each other. With the forces encountered in normal usage this risk may be fairly small since the walls of the teat nipple shaft portion made of an elastic material are being compressed when introducing the clamp member end into the teat nipple and may again expand when in a position beyond the external profile section so that especially with slightly undersize dimensions an appreciable resistance must be overcome when trying to pull out of the aperture in the mouth plate the clamp member end having the external profile sections.

One heretofore known soothing teat as disclosed in the German Utility Model No. 1,897,076 includes a massive clamp member with a tapered section and a locking head that may be likewise of a conical configuration. This locking head is of an oversize dimension with respect to the size of the aperture in the mouth plate. In this prior art soothing teat the clamp member material must exhibit a certain resiliency because the locking head must be deformable since otherwise it would be impossible to pass the locking head through the aperture in the mouth plate. During this insertion, the rubber of the soothing teat is necessarily subjected to rather high squeezing forces. This obligatory resiliency of the material allows, of course, to withdraw the locking head in the same manner. The resistance forces that have to be overcome when inserting or withdrawing the head are essentially of equal magnitude.

When manufacturing the clamp member of a resilient or elastic material, there arises a problem when sterilizing the soothing teat in boiling water. At the boiling temperature of water the elasticity or deformability of the soothing teat elements may be degraded or become entirely lost.

Similar disadvantages will be encountered when utilizing a mounting assembly with a split clamp member as described above. Devices of this type are shown e.g. in the German Utility Models No. 1,983,143 and No. 1,946,422. In the prior art devices described in these Utility Models, the clamp member comprises a split shaft portion with enlarged heads that will have to be urged through the aperture in the mouth plate. Because of the resiliency required, the split clamp member must be made integrally of a resilient material. During assembling, the materials are subjected to high stresses, and this is particularly true for the teat nipple shaft portion. The mounting is very unsafe because when applying withdrawal forces the expanded legs of the split clamp member may be compressed. This disadvantage is especially pronounced in the device of the German Utility Model No. 1,983,143 because this device includes bead shaped external profile sections whereas in the device of the German Utility Model No. 1,946,422 there is provided a substantially hemi-spherical profile section. The required elasticity, however, does not prevent these parts from becoming disassembled by pulling out forces.

It has also been already proposed to provide locking elements in the form of lugs at the mounting end portion of the clamp member. An arrangement of this type is shown in the German Utility Model No. 1,761,715. Lugs per se may likewise be employed in a particularly preferred embodiment of the present invention. In the prior art device of the above cited German Utility Model No. 1,761,715 the lateral lugs at the head of the split clamp member must be highly resilient and are of a flap or spur type configuration. When introducing the clamp member head through the aperture of the mouth plate, these lugs must be bent in a direction toward the closed end of the clamp member. Depending upon the length of these flaps or spurs, the mouth plate must be slidably displaced until the flaps or spurs may "snap back" within the teat nipple shaft portion. If the clamp member shaft portion is of a sufficient length, the mouth plate will not be positively retained, i.e. is movably held what is of course disadvantageous in the usage of the soothing teat. Another drawback of this known arrangement is that the rubber material of the teat nipple shaft is overstressed in the regions of the points of the so-called flaps or spurs and subjected to a permanent elongation stress leading to rapid aging.

If the flaps or spurs are of sufficient elasticity to allow bending when introducing the clamp member, this elasticity likewise allows bending in the opposite direction in thus decreasing the retaining capacity and safety.

In the German Laying-Open specification No. 2,420,829 has been proposed a soothing teat having a split clamp member with enlarged head portions at the clamp member ends, and an additional split ring disposed within the cavity of the teat nipple. This split ring is intended to more safely retain the teat nipple at the mouth plate. When assembling, this split ring must likewise be initially introduced into the teat nipple proper through the mouth plate aperture and subsequently be attached in a position in which the head of the split clamp member may be inserted through the split ring which is disposed within the interior cavity of the teat nipple. An assembly of this type is rather complicated, and the assembly operation is quite expensive. This embodiment likewise relies on elastically cooperating elements. By the split ring the material of the teat nipple is subjected to high stresses.

It is the object of the present invention to provide a novel and improved mounting assembly for infants' soothing teats.

It is another object of the present invention to provide a novel and improved mounting assembly for infants' soothing teats of the type generally defined in the beginning of the present specification which assembly not only practically eliminates stressing of the teat nipple material during assembling but also allows to increase the above described undersize dimensions without thereby interfering with the retaining properties in the assembled condition but, on the contrary, provides an improved safely retained assembly, in comparison to heretofore known arrangements, and wherein these desired properties will be retained even after boiling treatments.

In accordance with the present invention, these objects are achieved by a mounting assembly for infants' sooothing teats wherein the external profile section of the clamp member includes an abutment surface that is inclined to the longitudinal axis of the clamp member and facing the mouth plate, and the clamp member includes a movable locking element adapted to engage the abutment surface when the clamp member has been inserted into the teat nipple shaft portion whereby the locking element is being retained in an outwardly projecting position. The movable locking element allows to manufacture the clamp member of a nondeformable material whereby the clamp member end portion may be inserted through the mouth plate aperture virtually without overcoming any resistance and without stressing the teat nipple material. The locking elements greatly increase the rigidity of the assembly against pulling-apart or disintegrating forces.

In a particularly preferred embodiment the locking elements may consist of lugs disposed adjacent the end of the clamp member mounting portion, and the lugs are hingedly articulated on the clamp member in positions adjacent the external profile sections and are adapted to engage an adjacent abutment surface of the external profile section when in an outwardly projecting position whereby the lugs project beyond the profile sections.

Every embodiment in which the inserted clamp member mounting end includes an enlargement is thus provided with additional expandable locking elements engaging in the locking position the profile section wall portions facing the mouth plate and thus being safely retained in this position. Advantageously, these additional movable locking elements or articulated lugs may, upon insertion into a reduced diameter portion of the clamp member shaft, engage rear wall portions of the profile sections so that stresses on the teat nipple shaft are drastically reduced, i.e. virtually avoided.

Advantageously, the lugs may be erected into an outwardly projecting position beyond a top dead center position so as to be retained by the elastic teat nipple shaft portion. In this position, the articulated lugs effectively cooperate with the elasticity of the teat nipple shaft. By this movement beyond a top dead center position is provided an additional safety feature preventing an inward movement of the lugs when relative movements occur between the assembled teat nipple components, and this the more so since the elastic teat nipple material defines a retaining arrangement that is temporarily stressed when passing through the top dead center position so that the compressive tension forces ensure the erect position.

Preferably, the abutment wall portion is inclined outwardly and toward the front end of the clamp member mounting portion, and the upper end of the lugs are inclined with respect to the clamp member end when in an erect position so that the upper end of each lug is closer to the clamp member end than the root of each lug. This provides a rigid support in the locking position, and the displacement of the lug upper ends with respect to the lug roots allows this movement through the top dead center position.

When the clamp member is of a flat configuration and the profile sections substantially consist of wedged points disposed along both sides of the clamp member, the lugs may preferably be made of an elastic material and are integral with the clamp member and extend in a generally outward direction or in a direction inclined toward the clamp member end. This arrangement allows for an inherent resiliency for moving the lugs into the erect or locking position so that when introducing the clamp member end the lugs engaging the clamp member shaft will be biased by this spring force.

With a flat clamp member configuration as pointed out above the lugs may suitably be of a strip shaped configuration and extend from the narrow sides of the clamp member. Alternatively may be provided erectile lugs engagable with the narrow sides.

In an advantageous embodiment, the lugs may be of a substantially triangular cross-sectional configuration and may be adapted to engage a wall surface that is inclined outwardly toward the clamp member end whereby an outer wall of the lug having a triangular configuration extends approximately perpendicularly of the longitudinal axis of the clamp member. This arrangement ensures a highly stable interlocking because with this triangular cross-sectional configuration the lugs themselves are not resilient along their length but the triangular configuration readily allows a movement through a top dead center position.

The clamp member may likewise be of a circular cross-section, and the external profile section may consist of an annular peripheral bead. In this embodiment at least one pair of lugs may be arranged at diametrically opposed locations of the external circumference of the clamp member or alternatively a plurality of lugs may be spaced about the periphery of the external circumference of the clamp member. The root of each lug is provided at a flattened peripheral surface portion of the clamp member adjacent the external profile section. The flattened peripheral surface portions allow to articulate the lugs. Preferably, there may be provided three lugs that are mutually displaced by 120° about the periphery. A clamp member with a shaft of circular cross-section is suitable especially for standard type soothing teats whereas flat clamp members are more preferred for comforters.

In accordance with another preferred embodiment at least one of the external profile sections at the mounting end of the flat clamp member includes a wedge type wall surface extending from the apex of the external profile section at the clamp member mounting end inwardly toward an outer clamp member end to which is attached a holding means, the locking element at the clamp member mounting end consisting of a wedge member with a supplementary ramp surface connected to the clamp member by a connecting strip, the wedge member is adapted to be drawn against the clamp member shaft portion in one position, and to be slidably moved along the ramp surface toward the clamp member end in another position, and furthermore is adapted to be moved outwardly along an engagement rim extending substantially perpendicularly of the longitudinal axis of the clamp member.

In this aforedescribed embodiment, the ramp surface at the mounting end of the clamp member practically points toward the outer clamp end attaching a holding means, and the actual abutment is defined by at least one wedge member serving as an expanding means by which the height of the external profile section is increased when moving this wedge member toward the clamp member end. This arrangement allows for a flat configuration when introducing the clamp member, and expanding by a suitable manipulation. Suitably, a wedge member is arranged at each side wall of the clamp member in the region of the outer surface of each clamp member leg.

Advantageously, a backing strip is provided at the side of the wedge member facing the clamp member shaft portion in the region of the end of the engagement rim, the backing strip extending toward the end of the clamp member and serving to move the wedge member forwardly and outwardly into the teat nipple when the clamp member has been inserted into the aperture of the mouth plate, the clamp member shaft portion including a recess for receiving the backing strip in the advanced position of the wedge member. This arrangement not only provides a handle for moving the one or the several wedge members from the outside, but likewise a locking means retaining the wedge members in the advanced position. For increased safety, the recess is advantageously disposed in a region surrounded, in the assembled condition of the soothing teat, by a bead on the teat nipple at the inner surface of the mouth plate.

In all of the aforedescribed embodiments the locking elements, whether in the form of lugs or of wedge members, are arranged at a reduced portion of the clamp member shaft when introducing the clamp member into the teat nipple so that the locking elements do not project beyond the profile sections along the clamp member head or the clamp member mounting end respectively. The above described movements and support arrangements may be achieved with non-deformable materials whereby merely in the region of the retaining zone yieldable properties are provided but the respective parts need not be resilient or elastic. Introducing of the clamp member is greatly faciliated and stresses on the teat nipple are avoided. The mouth plate may be made of a relatively rigid material. The profile sections at the clamp member mounting end may be of a cross-sectional size smaller than the aperture in the mouth plate or may be of substantially equal size as this aperture.

In the following, the present invention will be explained more in detail with reference to several illustrative embodiments shown in the appended drawings. These drawings are partly drawn in an enlarged scale.

Figure 2:
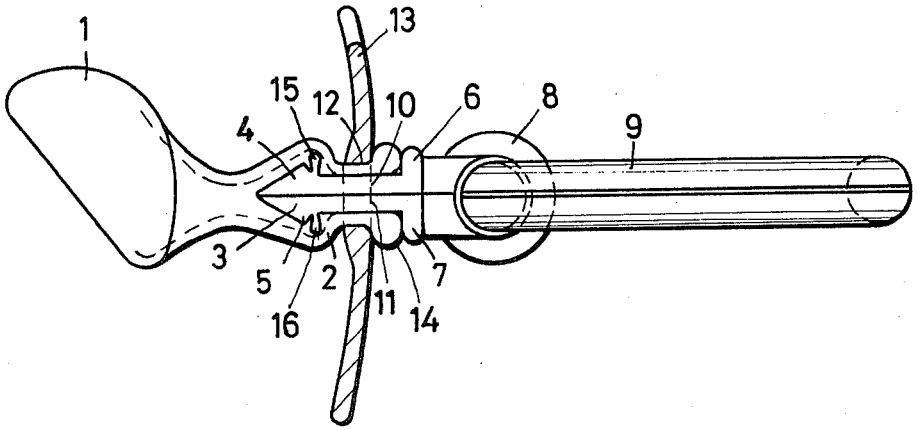
FIG. 2 is a partly sectional lateral elevational view of the soothing teat assembly of FIG. 1.
Figure 1:
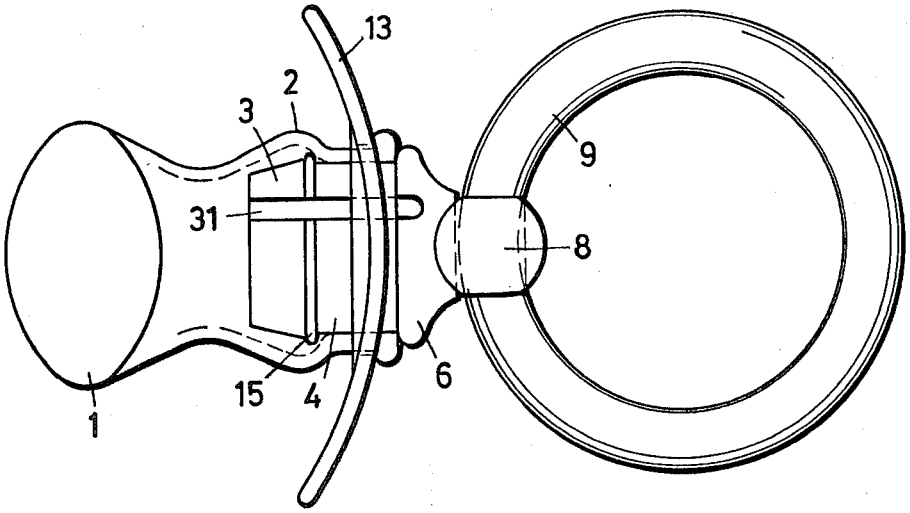
FIG. 1 is a top view of a first embodiment of a soothing teat assembly in accordance with the present invention.

Referring to FIGS. 1 and 2, the soothing teat shown therein includes a teat nipple 1 made of an elastic material such as rubber. The teat nipple 1 consists of a bulb shaped portion from which extends a shaft portion 2 of a flattened configuration. The shaft 2 is slipped over a clamp member 3 that is likewise of a mating flat configuration. The clamp member 3 includes at either of its flat sides a pair of external profile sections 4, 5 at the mounting end which is inserted into the teat nipple 1, and another pair of external profile sections 6, 7 at the outer end of the clamp member, i.e. the end outside the teat nipple. This outer end of the clamp member 3 defines a ring 8 for attaching a holding means 9. The shaft of the clamp member 3 consists of a pair of legs 10, 11 that engage each other along one side in mutual surface engagement. The profile sections 4, 5 are of a wedge type configuration. The flat clamp member portion intermediate the profile sections 4, 5 and the profile sections 6, 7 projects through an aperture 12 of a mouth plate 13, and the teat nipple shaft portion includes an annular peripheral bead 14 that is external of the mouth plate, i.e. on the side of the holding means. The clamp member shaft is bulging outwardly at the profile sections 4, 5 in thus defining a bead preventing withdrawal of the clamp member.

The resistance against withdrawal of the clamp member 3 is further increased by articulated lugs 15, 16 provided adjacent the profile sections 4, 5. When introducing the clamp member 3 into the teat nipple shaft 2 which extends through the aperture 12 of the mouth plate 13 the lugs 15, 16 bend sideways and engage the clamp member surface. When trying to withdraw the clamp member, the lugs 15, 16 will assume an erect or projecting position.

Figure 3:
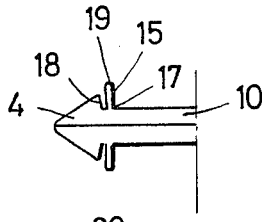
FIG. 3 is a fragmentary elevational view of FIG. 2.
Figure 4:
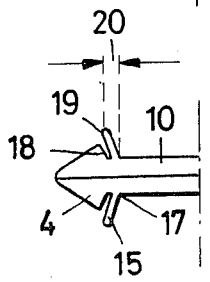
FIG. 4 is a view similar to FIG. 3 but showing another embodiment.
Figure 5:
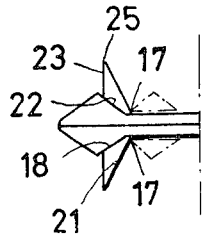
FIG. 5 is a view similar to FIG. 3 but showing another embodiment.

Referring to FIGS. 3 to 5, there is shown one leg 10 of the clamp member. As shown in FIG. 3, this leg includes a wedge type and forwardly and outwardly inclined profile section 4 and adjacent this profile section 4 the articulated lug 15, the root 17 of which is integral with the leg and connected thereto at a position immediately adjacent an abutment surface 18 extending perpendicularly of the longitudinal extension or axis of the clamp member. The lug 15 includes a rounded upper portion 19 extending outwardly beyond the profile section 4. When introducing the clamp member into the teat nipple, the lug 15 will be bent sideways toward the leg 10. In the inserted position, the lug 15 will snap back into an erect or outwardly projecting position, due to its inherent elasticity provided by the root attachment.

As may be seen in FIG. 4, the wall portion 18 of the profile section 4 may advantageously be inclined forwardly and outwardly. The lug 15 may therefore assume an inclined position as shown when a force in withdrawal direction acts on the clamp member. In this inclined position of the lug 15 the rounded upper portion 19 of the lug will be displaced against the root 17 by a distance 20 whereby this displacement is caused by the expanding material of the teat nipple shaft which elastic material is under a compressive stress. In this manner the advantageous movement across a top dead center position of the lug is achieved.

In the embodiment shown in FIG. 5 the profile section likewise includes an inclined wall portion 18 but the lug 21 is of a triangular cross-section and the root 17 of the lug is disposed within a corner. The wall surface 22 engaging the abutment surface 18 is extended in an outward direction by a wall 23 that extends substantially perpendicularly of the longitudinal axis of the clamp member when the lug 21 is in the locking position. In this embodiment, the outer end 25 of the lug is likewise displaced toward the inner end of the clamp member with respect to the root 17 of the lug so that the described movement across the top dead center position will be achieved, and additionally the erection movement of the lug is performed in a highly efficient manner, due to the angular configuration of the triangular lug. When introducing the clamp member the lug bends sideways into the position 26 shown in dotted lines in which position the lug does not project away further from the leg than the profile section 4.

Figure 6:
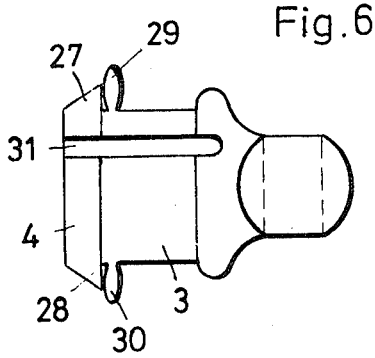
FIG. 6 is a top view of the clamp member of FIGS. 1 and 2, the clamp member being modified.

FIG. 6 is a top view of a clamp member 3. In this embodiment, the profile sections 4, 5 along the narrow sides include nose portions 27, 28. Associated with these nose portions 27, 28 are suitably articulated lugs 29, 30 that may be of any of the aforedescribed designs.

The profile sections 6, 7 of the clamp member may of course likewise be provided with lateral nose portions. The clamp member includes at least on one side a vent passage 31 extending through the profile section.

Figure 8:
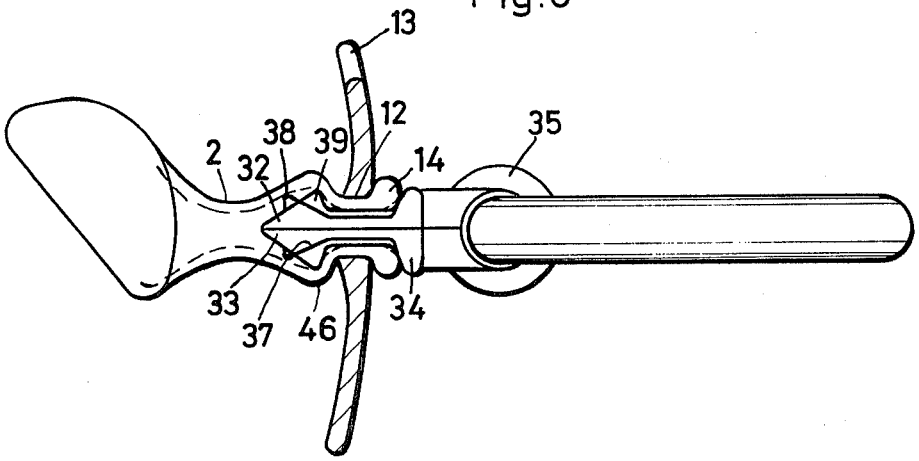
FIG. 8 is a partly sectional elevational view of an assembled soothing teat having a clamp member of the type shown in FIG. 7.
Figure 7:
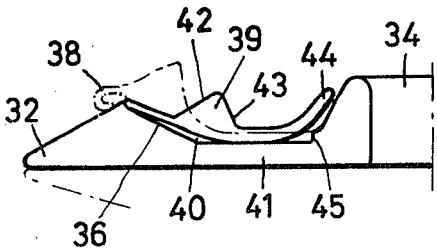
FIG. 7 is a lateral elevational view of another embodiment of a clamp member in one operational condition.

Referring to FIGS. 7 and 8, there is shown still another embodiment. In this embodiment is provided a split clamp member 34 consisting of a pair of legs 32, 33 interconnected by a holding ring 35 for a holding means. At the mounting end of the clamp member 34 are provided ramp surfaces 36, 37 inclined from the apex, i.e. the highest point of the profile section adjacent the clamp member mounting end inwardly toward the other clamp member end defining attachment means 35 for a holding ring or the like. In the following, only one leg of the clamp member will be described since the other clamp member leg is of an identical configuration. The mounting end of the clamp member leg is connected by a thin integral connecting strip 38 to a wedge member 39. The wedge member 39 defines a ramp surface 40 of a configuration mating the above described ramp surface 36. When mutually displacing these two ramp surfaces, the wedge member 39 may be moved into the withdrawn position against the clamp member shaft 41, as shown in FIG. 7, or may be moved into an extended position shown in FIG. 8 in which an outer portion 42 of the wedge member and particularly an engagement rim 43 thereof extending substantially perpendicularly of the longitudinal axis of the clamp member is in an exterior position. The strip 38 is of a sufficient length in order to allow both of the described movements.

The movement actuating means for adjusting the wedge member 39 between the two described positions consists of a backing strip 44 arranged along an engagement rim 43 at the edge facing the clamp member shaft. This backing strip 44 may be reinforced in comparison to the connecting strip 38. A recess 45 is associated with the backing strip 44 along each leg 32, 33 or respectively along the clamp member shaft 41. The backing strip 44 may be received by this recess 45 when the wedge member 39 is in its advanced position. The backing strip 44 is retained in its position by the fact that the backing strip as well as the recess 45 are disposed, in the assembled condition of the soothing teat, within a region in which the bead 14 of the teat nipple 1 is internally of a mouth plate 13. The elastic material of the bead ensures that the one backing strip 44 or several backing strips are retained in the one or respectively several associated recesses 45.

As may be seen in FIG. 8, the advanced wedge members 39 effect an outward expansion of the engaged teat nipple shaft portion 2 as at 46, and this expansion prevents withdrawal of the clamp member through the opening 12 of the mouth plate when pulling at the attachment ring 35.

Figure 9:
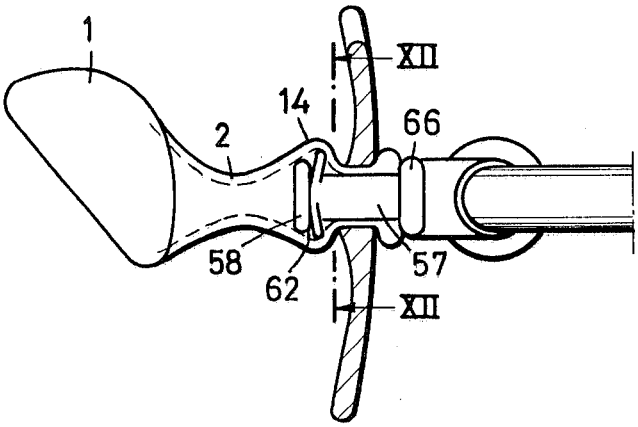
FIG. 9 is a partly sectional lateral elevational view of a soothing teat assembly with a clamp member of still another embodiment.
Figure 10:
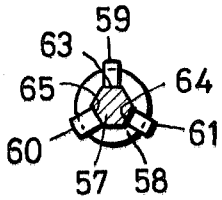
FIG. 10 is a sectional view along the line X—X of FIG. 9.

In the embodiment shown in FIGS. 9 and 10, the clamp member shaft 57 is of a circular cross-section and the external profile section consists of a peripheral annular bead 58. Having the above described figures of the drawings in mind, it may readily be appreciated how a clamp member of this type may be connected to a teat nipple 1 having a cylindrical shaft 2 with a bead 14 at its outer end. This bead 14 surrounds the clamp member shaft 57 at the side of the peripheral bead 58 facing another annular bead 66.

As may be seen in FIG. 10, this embodiment includes three articulated lugs 59, 60, 61 that are evenly spaced about the circumference of the clamp member shaft. These lugs 59 to 61 are of one of the above described designs and are each associated with a support surface or wall portion 62 at the bead 58. With a clamp member shaft 57 of circular cross-section it is important that the peripheral surface portions 63, 64, 65 at the roots of the lugs 59 to 61 are flattened in defining straight bending edges. In this embodiment the lugs 59 to 61 likewise constitute expanding members increasing the outward bulge of the bead 58 in thus providing a greater resistance of the clamp member against withdrawal from the assembly.

As may be seen from the embodiment shown in FIGS. 1 and 2, the clamp member is adapted to be initially inserted over a substantial length into the teat nipple, in compressing the bead 14 of the teat nipple. Subsequently, the clamp member may be withdrawn whereby the elasticity of the expanding bead retains the mouth plate 13 at a minimum spacing from the articulated lugs 15, 16.

What is claimed is:

1. An assembly for an infant's soothing teat or pacifier comprising a teat nipple made of an elastic material, said teat nipple including an axially elongated hollow shaft portion forming one end of said nipple and the end of said nipple formed by said shaft portion having an opening to the hollow interior thereof, an axially elongated clamping member inserted into said shaft portion through the opening therein with said shaft portion laterally enclosing said clamp member, said clamp member having a profiled configuration on the surface thereof inserted into said shaft portion with the profiled configuration projecting outwardly transversely of the axially elongated direction of said clamp member, the elastic said shaft portion conforming to the profiled configuration of said clamp member, said clamp member having a first end located within said shaft portion and a second end located exteriorly of said shaft portion when said clamp member is inserted into said shaft portion, a mouth plate having an aperture therethrough, said shaft portion extending through the aperture in said mouth plate with said clamp member inserted within said shaft portion, the opening in the end of said shaft portion being located on one side of said mouth plate and the profiled configuration of said clamp member being located on the other side of said mouth plate within said shaft portion, said clamp portion having a body portion extending in its elongated direction into said shaft portion and said profiled configuration comprising at least one element projecting outwardly from said body portion transversely of the longitudinal axis of said shaft portion, said element having an abutment surface extending at an angle to the longitudinal axis of said clamping portion and in the inserted position of said clamping member within said shaft portion said abutment surface faces generally toward the opening into said shaft portion, is spaced therefrom and is located on the opposite side of said mouth plate from the opening, and a locking element secured to said body portion of said clamping member and extending outwardly from said body portion transverely of the longitudinal axis of said clamping member and located between said abutment surface and said mouth plate when said clamping member is inserted into said shaft portion, said locking element being movably displaceable relative to said body portion when said clamp member is inserted into said shaft portion about the point of securement of said locking element to said body portion.

2. An assembly, as set forth in claim 1, wherein said locking element extends laterally outwardly from said element forming the profiled configuration in the inserted position of said clamp member within said shaft portion and said locking element being capable of movable displacement into contact with said abutment surface for effecting locking action of said clamp member within said shaft portion.

3. An assembly, as set forth in claim 2, wherein said locking element being displaceable about the point of securement of said locking element to said body portion into an upper dead center position in contact with the inner surface of said shaft portion when said clamp member is in the inserted position within said shaft portion.

4. An assembly, as set forth in claim 3, wherein said locking member being inclined from the point of securement to said body portion toward the first end of said clamp member and disposed in spaced relation to the abutment surface on said element in the undeflected position of said locking element.

5. An assembly, as set forth in claim 2, wherein said body portion of said clamp member is flat, said profiled configuration located at the first end of said clamp member on said body portion comprising two said elements forming a wedge-shaped end on said clamp member and said locking element extending from the opposite flat sides of said body portion.

6. An assembly, as set forth in claim 5, wherein said locking elements arranged as strips extending outwardly from each of the flat sides of said clamp member.

7. An assembly, as set forth in claim 6, wherein said clamp member has narrow sides extending transversely of said flat sides, and a locking element extending laterally outwardly from each of said narrow sides at a location adjacent said element forming the profile configuration.

8. An assembly, as set forth in claim 2, wherein said locking element is triangular in cross section taken in the longitudinal direction of said clamp member with one of the edges of said locking element extending outwardly from said element forming the profiled configuration and disposed substantially perpendicularly to the longitudinal axis of said clamp member.

9. An assembly, as set forth in claim 2, wherein said first end of said clamp member being circular in cross section extending transversely of the longitudinal axis of said clamp member and said element forming the profiled configuration comprising a circumferential bead extending around the outer surface of said first end of said clamp member, said locking members comprising at least two extensions connected to and extending outwardly from said body portion of said clamp member adjacent said first end thereof with said locking members being distributed angularly apart forming a star-shaped cross section on said body portion of said clamp member and the surface of said body portion from which said locking elements extend being flattened.

10. An assembly, as set forth in claim 2, wherein said element forming the profiled configuration on the first end of said clamp member comprising a wedge-shaped surface with the apex thereof directed laterally outwardly from said clamp member, said locking element comprising a connecting strip attached to said element adjacent the apex thereof and said locking element including a complementary wedge-shaped surface joined to said connecting strip and said locking element being displaceable along the surface of said clamp member as said clamp member is inserted into said shaft portion.

11. An assembly, as set forth in claim 10, wherein said body portion of said clamp member having a pair of opposite sides, said opposite sides of said clamping member each having a complementary shape, and one side locking element attached to each of the opposite sides of said body portion.

12. An assembly, as set forth in claim 11, wherein said body portion on the opposite side having a recess, said locking element on said opposite sides of said body portion having a supporting strip extending from the wedge-shaped surface thereon away from the first end of said clamp member, said supporting strip being displaceable with said locking element and being insertable into the recess on the same side of said body portion when said clamp member is inserted into said shaft portion of said nipple.

13. An assembly, as set forth in claim 12, wherein said shaft portion of said nipple having a bead formed on the outer surface thereof and extending outwardly therefrom in the region of said recess in said body portion of said clamp member when said clamp member is inserted into said shaft portion.

* * * * *